US010272680B2

(12) United States Patent
Chen et al.

(10) Patent No.: US 10,272,680 B2
(45) Date of Patent: Apr. 30, 2019

(54) FLUID EJECTION DEVICE

(71) Applicant: HEWLETT-PACKARD DEVELOPMENT COMPANY, L.P., Houston, TX (US)

(72) Inventors: Chien-Hua Chen, Corvallis, OR (US); Gary G. Lutnesky, Corvallis, OR (US); Michael W. Cumbie, Corvallis, OR (US)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 15/570,785

(22) PCT Filed: May 15, 2015

(86) PCT No.: PCT/US2015/030958
§ 371 (c)(1),
(2) Date: Oct. 31, 2017

(87) PCT Pub. No.: WO2016/186603
PCT Pub. Date: Nov. 24, 2016

(65) Prior Publication Data

US 2018/0134038 A1 May 17, 2018

(51) Int. Cl.
*B41J 2/14* (2006.01)
*B41J 2/16* (2006.01)
(Continued)

(52) U.S. Cl.
CPC ..... *B41J 2/14145* (2013.01); *B41J 2/14072* (2013.01); *B41J 2/14201* (2013.01);
(Continued)

(58) Field of Classification Search
CPC .... B41J 2/14145; B41J 2/14201; B41J 2/155; B41J 2/1601; B41J 2/1607; B41J 2/1632;
(Continued)

(56) References Cited

U.S. PATENT DOCUMENTS 6,281,914 B1 8/2001 Hiwada et al.
6,357,864 B1 3/2002 Sullivan
(Continued)

FOREIGN PATENT DOCUMENTS

CN 1590104 A 3/2005
CN 102036825 A 4/2011
(Continued)

OTHER PUBLICATIONS

Manufacture of an Integrated Three-Dimensional Structure Nozzle Plate Using Microinjection Molding for a 1200-dpi Inkjet Printhead Sheng-Chih Shen, Min-Wen Wang, and Chung-Jui Lee Journal of Microelectromechanical Systems, vol. 18, No. 1, Feb. 2009 (Year: 2009).*

*Primary Examiner* — Huan H Tran
*Assistant Examiner* — Alexander D Shenderov
(74) *Attorney, Agent, or Firm* — HP Inc. Patent Department

(57) ABSTRACT

A fluid ejection die is described. The fluid ejection die comprises at least one nozzle to dispense fluid and is coupled to a support manifold. The support manifold has at least one channel passing therethrough to communicate fluid to the fluid ejection die for dispensation. The at least one channel has a fluid contact surface, and the support manifold comprises at least one recessed structure that is spaced apart from the fluid contact surface.

19 Claims, 7 Drawing Sheets

(51) Int. Cl.
*B41J 2/21* (2006.01)
*B41J 2/155* (2006.01)

(52) U.S. Cl.
CPC ..... *B41J 2/155* (2013.01); *B41J 2/1601* (2013.01); *B41J 2/1603* (2013.01); *B41J 2/1607* (2013.01); *B41J 2/1632* (2013.01); *B41J 2/1634* (2013.01); *B41J 2/2103* (2013.01); *B41J 2002/14419* (2013.01); *B41J 2202/11* (2013.01); *B41J 2202/13* (2013.01)

(58) Field of Classification Search
CPC ..... B41J 2/1634; B41J 2/2103; B41J 2002/14419; B41J 2002/13
USPC ..... 347/47
See application file for complete search history.

(56) References Cited

U.S. PATENT DOCUMENTS 6,565,760 B2 5/2003 Hardisty et al.
7,347,533 B2 3/2008 Elrod et al.
7,862,160 B2 1/2011 Andrews et al.
8,398,208 B2 3/2013 Lee et al.
8,622,524 B2 1/2014 Anderson et al.
2003/0007034 A1* 1/2003 Horvath ..... B41J 2/14024 347/50
2007/0285471 A1 12/2007 Park et al.
2009/0289994 A1* 11/2009 Nystrom ..... B41J 2/155 347/33
2011/0037808 A1 2/2011 Ciminelli et al.
2012/0019600 A1* 1/2012 Arthur ..... B41J 2/1623 347/54
2013/0063527 A1 3/2013 Ge et al.
2013/0083120 A1 4/2013 Choy
2014/0055528 A1 2/2014 Bibl et al.
2017/0066242 A1* 3/2017 Chen ..... B41J 2/1637
2017/0266973 A1* 9/2017 Choy ..... B41J 2/14072

FOREIGN PATENT DOCUMENTS

CN 103552379 A 2/2014
WO WO-2014209506 12/2014

* cited by examiner

FLUID EJECTION DEVICE

BACKGROUND

Printers are devices that deposit a fluid, such as ink, on a print medium, such as paper. A printer may include a printhead that includes a fluid reservoir. The fluid may be expelled from the printhead onto a print medium via a fluid ejection device of the printhead.

DRAWINGS

Throughout the drawings, identical reference numbers designate similar, but not necessarily identical, elements. The figures are not necessarily to scale, and the size of some parts may be exaggerated to more clearly illustrate the example shown.

DESCRIPTION

A fluid ejection device generally comprises a fluid passage from a fluid reservoir to one or more nozzles for dispensation of a fluid. For example, a fluid ejection device for ink printing comprises a channel that may be fluidly connected to an ink reservoir. Ink stored in the ink reservoir may flow through the channel to one or more nozzles of the fluid ejection device. As will be appreciated, a fluid ejection device is generally an integrated circuit (IC) formed on a substrate. Conductive traces may electrically connect fluid ejectors of a fluid ejection device to external circuits to facilitate control of the dispensing of fluid with the fluid ejection device. However, materials used for the fluid ejection device and the types of fluid that the fluid ejection device may dispense may give rise to reliability issues for the fluid ejection device. For example, for a fluid ejection device for dispensing ink, ink may leak and/or seep from a channel and contact conductive traces of the fluid ejection device, which may lead to shorted electrical connections. In some examples described herein, a fluid contact surface of a channel may be formed of a substantially uniform epoxy or other such material that may reduce fluid leakage and/or seepage. Furthermore, in some examples described herein, structures comprising conductive traces for the fluid ejection device may be positioned in the fluid ejection device such that the conductive traces are spaced apart from the channel and such that the conductive traces are sealed by a material to reduce fluid leakage and/or seepage proximate the conductive traces.

Figure 1:
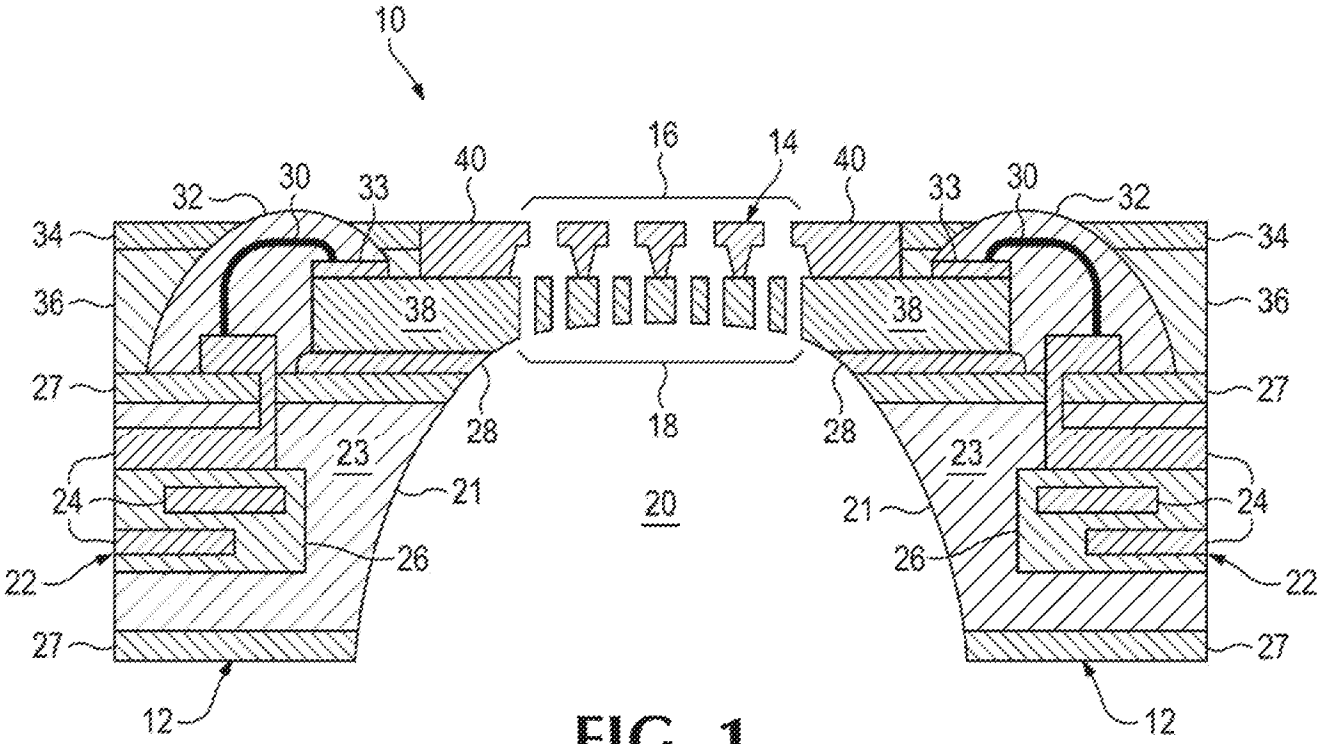
FIG. 1 is a cross-sectional view that illustrates an example of a fluid ejection device.

Turning now to FIG. 1, this figure provides a cross-sectional view of an example fluid ejection device 10. In this example, the fluid ejection device 10 comprises a support manifold 12 and a fluid ejection die 14 coupled to the support manifold 12. As shown, the fluid ejection die 14 comprises one or more nozzles 16 that may expel/dispense fluid. While not shown in the cross sectional view, generally, fluid ejection devices may comprise fluid ejectors positioned proximate a respective nozzle 16 and configured to cause fluid to be dispensed from the nozzle 16. For example, a thermal fluid ejector may be positioned proximate a respective nozzle 16, and, upon actuation, the thermal fluid ejector may conduct heat into a fluid to cause the fluid to dispense from the respective nozzle 16. As another example, a piezoelectric fluid ejector may be positioned proximate a respective nozzle 16, and, upon actuation, the piezoelectric fluid ejector may generate a pressure pulse to cause fluid to dispense from the respective nozzle 16. A port 18 may be connected to each nozzle 16 such that fluid may be communicated through the port 18 to the nozzle 16 for dispensing of the fluid.

The support manifold 12 is configured with one or more channels 20 that pass through the support manifold 12 such that each channel 20 is in fluid communication with one or more ports 18 and one or more nozzles 16 such that fluid may be communicated from a fluid reservoir, through the channel 20 to the one or more nozzles 16 for dispensing. For example, if the fluid is ink for an ink printer, ink may be stored in an ink reservoir, and ink may be communicated from the ink reservoir to one or more nozzles 16 for dispensing via one or more channels 20 and one or more ports 18. As shown, each channel 20 has a fluid contact surface 21, where the fluid contact surface 21 generally corresponds to a surface with which a fluid passing through the channel 20 may interact. The support manifold 12 further comprises one or more recessed structures 22 and sealing structure 23, where each recessed structure 22 comprises one or more conductive traces 24 and one or more insulating layers 26. The support manifold 12 may comprise a laminate 27 and/or other type of sealant on a top and/or bottom surface. In this example, the fluid ejection die 14 is coupled to the support manifold 12 by an adhesive 28; however, other methods for coupling the fluid ejection die 14 to the support manifold 12 may be implemented.

For the example fluid ejection device 10 illustrated, a bond pad 33 of the fluid ejection die 14 is connected to at least one conductive trace 24 of the support manifold 12 with a bonding wire 30, which may be encapsulated with an insulating material 32. Generally, the conductive traces 24 of the support manifold 12 may be connected to an external circuit. In addition, the example fluid ejection device 10 includes a shroud 34 that may be coupled to the support manifold 12 and/or fluid ejection die 14 with an adhesive 36, where the shroud may be coupled to the fluid ejection device 10 to thereby provide a generally planar surface for the fluid ejection device 10. As will be appreciated, the shroud 34 may comprise a metal or metal based compound, and the shroud 34 may be patterned with openings so as not to interfere with the dispensation of fluid from the one or more nozzles 16.

The fluid contact surface 21 corresponds to the sealing structure 23, where the sealing structure 23 may comprise a material suited for contact with a type of fluid to be communicated through the channel 20. For example, the support manifold 12 may comprise a printed circuit board (PCB). In such examples, each recessed structure 22 may comprise an epoxy-reinforced material, such as an epoxy reinforced glass (referred to as "e-glass"), as one or more insulating layers 26. Each conductive trace 24 may comprise copper and/or other such conductive materials. For example, the support manifold 12 may comprise an FR-4 grade printed circuit board. The support manifold 12 may comprise different PCBs including different materials, such as ceramic. In addition, the support manifold 12 may correspond to a multi-layer PCB. As shown in the example fluid ejection device 10 of FIG. 1, the insulating layers 26 of the support manifold have been recessed—i.e., a portion of the insulating layers 26 have been removed, and the portion has been replaced with material corresponding to the sealing structure 23. In an example in which the support manifold 12 comprises a PCB, the sealing structure 23 may comprise an epoxy and/or an epoxy-based polymer, and the one or more insulating layers 26 may comprise a fiber reinforced polymer composite product, such as e-glass.

Therefore, the fluid contact surface 21 of a channel 20 of the example fluid ejection device 10 may correspond to the material of the sealing structure 23. In examples where the support manifold 12 comprises a PCB, the fluid contact surface may correspond to an epoxy and/or epoxy-based polymer material, and the insulating layers 26 may correspond to a reinforced glass compound. As will be appreciated, in the example of FIG. 1, the recessed structures 22 are spaced apart from the fluid contact surface 21, such that insulating layers 26 and/or conductive traces 24 may not contact a fluid being communicated through the channel 20. Generally, because the one or more recessed structures 22 are spaced apart from the fluid contact surface 21, shorting and/or corrosion of the conductive traces due to fluid exposure may be reduced. Furthermore, because the sealing structure 23 may comprise a substantially uniform material, such as an epoxy-based polymer, the fluid contact surface 21 may provide a substantially uniform interface for fluid flowing therethrough. In addition, substantial uniformity of material of the sealing structure 23 may provide a generally uniform interface for machining and/or chemical processes performed on the support manifold 12, such as micromachining and/or chemical processes for forming of a channel 20 therethrough.

Generally, a fluid ejection die 14 may be an integrated circuit (IC) structure formed on a substrate 38 (such as silicon). Thermal fluid ejectors, piezoelectric fluid ejectors, and/or other such fluid ejectors may be positioned proximate nozzles 16 and the fluid ejectors may be connected to external circuits through the bond pads 33 or other such electrical terminals. The nozzles 16 may be fabricated in an additional structure 40 coupled to the substrate 38, where the nozzles 16 may be micro-fabricated in the additional structure 40. Furthermore, in some examples, a fluid ejection die 14 may be a die sliver. Generally, a die sliver may correspond to a fluid ejection die 14 having: a thickness of approximately 650 μm or less; exterior dimensions of approximately 30 mm or less; and/or a length to width ratio of approximately 3 to 1 or larger.

Figure 2:
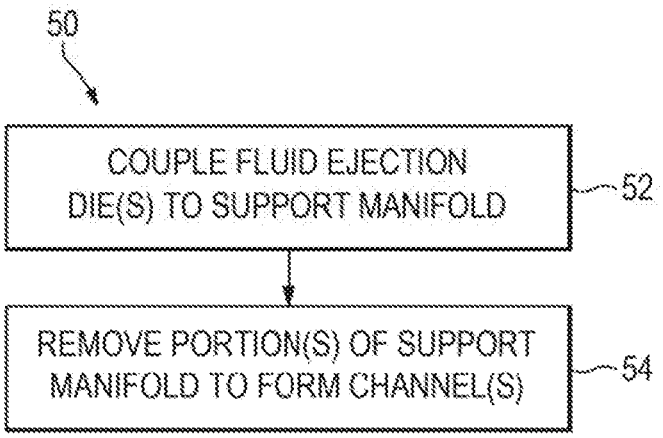
FIG. 2 is an example flowchart of a process for forming a fluid ejection device.

Turning now to FIG. 2, this figure provides a flowchart that illustrates an example process 50 that may be performed to form a fluid ejection device, such as the example fluid ejection device of FIG. 1. One or more fluid ejection dies 14 may be coupled to a support manifold 12 (block 52). In some examples consistent with the description, coupling a fluid ejection die 14 to a support manifold 12 may comprise coupling the fluid ejection die 14 to the support manifold 12 with an adhesive. In some examples consistent with the description, coupling a fluid ejection die to a support manifold may comprise molding the fluid ejection die to the support manifold. In some examples consistent with the description, coupling a fluid ejection die to a support manifold may comprise bonding the fluid ejection die to the support manifold. Other processes for coupling a fluid ejection die to the support manifold may be implemented in some examples of the description. One or more portions of the support manifold may be removed to form one or more channels (block 54). In some examples, removing a portion of the support manifold 12 may comprise plunge cutting the support manifold 12. In some examples, removing a portion of the support manifold 12 may comprise etching the portion of the support manifold 12. Other mechanical and/or chemical processes for removing a portion from the support manifold 12 may be implemented in some examples of the description.

Figure 3:
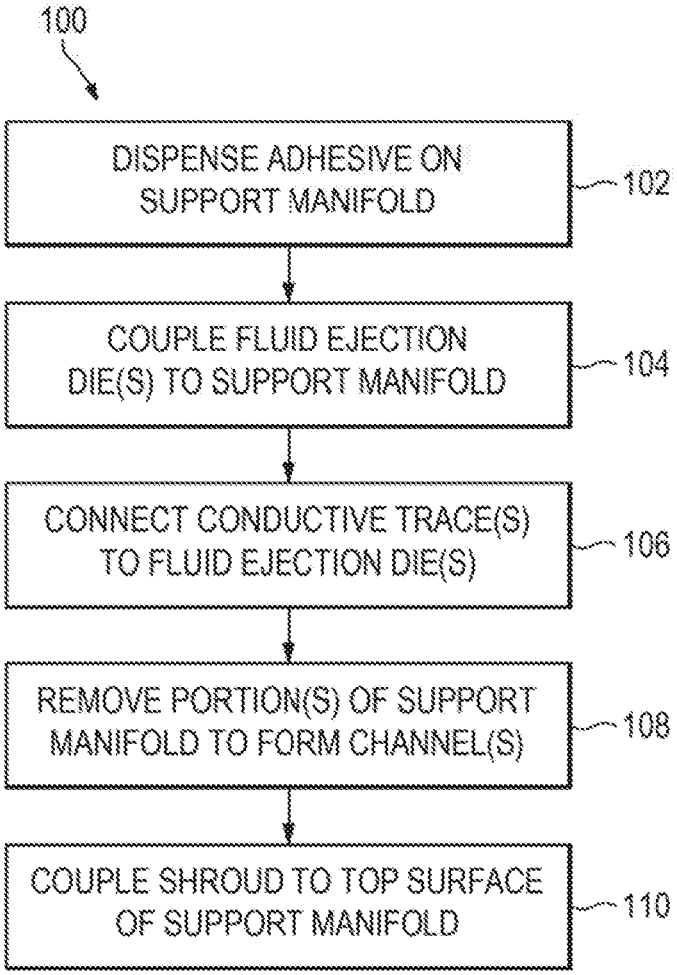
FIG. 3 is an example flowchart of a process for forming a fluid ejection device.

FIG. 3 provides a flowchart that illustrates an example process 100 that may be performed to form a fluid ejection device, such as the example fluid ejection device of FIG. 1. Adhesive 28 may be dispensed on a support manifold 12 (block 102), and one or more fluid ejection dies 14 may be coupled to the support manifold 12 with the adhesive 28 (block 104). One or more conductive traces 24 of the support manifold are connected to the one or more fluid ejection dies (block 106). As discussed, a fluid ejection die 14 may comprise a fluid ejector (e.g., a thermal fluid ejector, a piezoelectric fluid ejector, etc.), and connecting the conductive traces 24 of the support manifold 12 to the fluid ejection die 14 may facilitate control of one or more fluid ejectors of the fluid ejection die 14 via an external circuit connected to the conductive traces 24. Connecting a conductive trace 24 of the support manifold 12 to a fluid ejection die 14 may comprise bonding a conductive element 30 to the conductive trace 24 and a bonding pad 33 of the fluid ejection die 14. Furthermore, connecting the one or more conductive traces 24 to the one or more fluid ejection dies 14 may comprise encapsulating the connection.

One or more portions of the support manifold 12 may be removed to form one or more channels 20 in the support manifold 12 (block 108). As discussed, a channel 20 may be fluidly connected to one or more nozzles 16 of the fluid ejection die 14 to facilitate the passage of fluid to the one or more nozzles 16 via the channel 20. In some examples, removing a portion of the support manifold 12 to form a channel 20 may comprise plunge cutting (also referred to as "slot-plunge cutting"), routing, and/or laser ablating the support manifold 12. In some examples, a shroud 34 may be coupled to the fluid ejection device 10 on a top surface of the fluid ejection device 10 (block 110). In some examples, the shroud 34 may be coupled to the top surface of the fluid ejection device 10 with an adhesive 36. In some examples, a shroud 34 may be coupled to a top surface of the fluid ejection device 10 such that the top surface may be generally planar.

Figure 4:
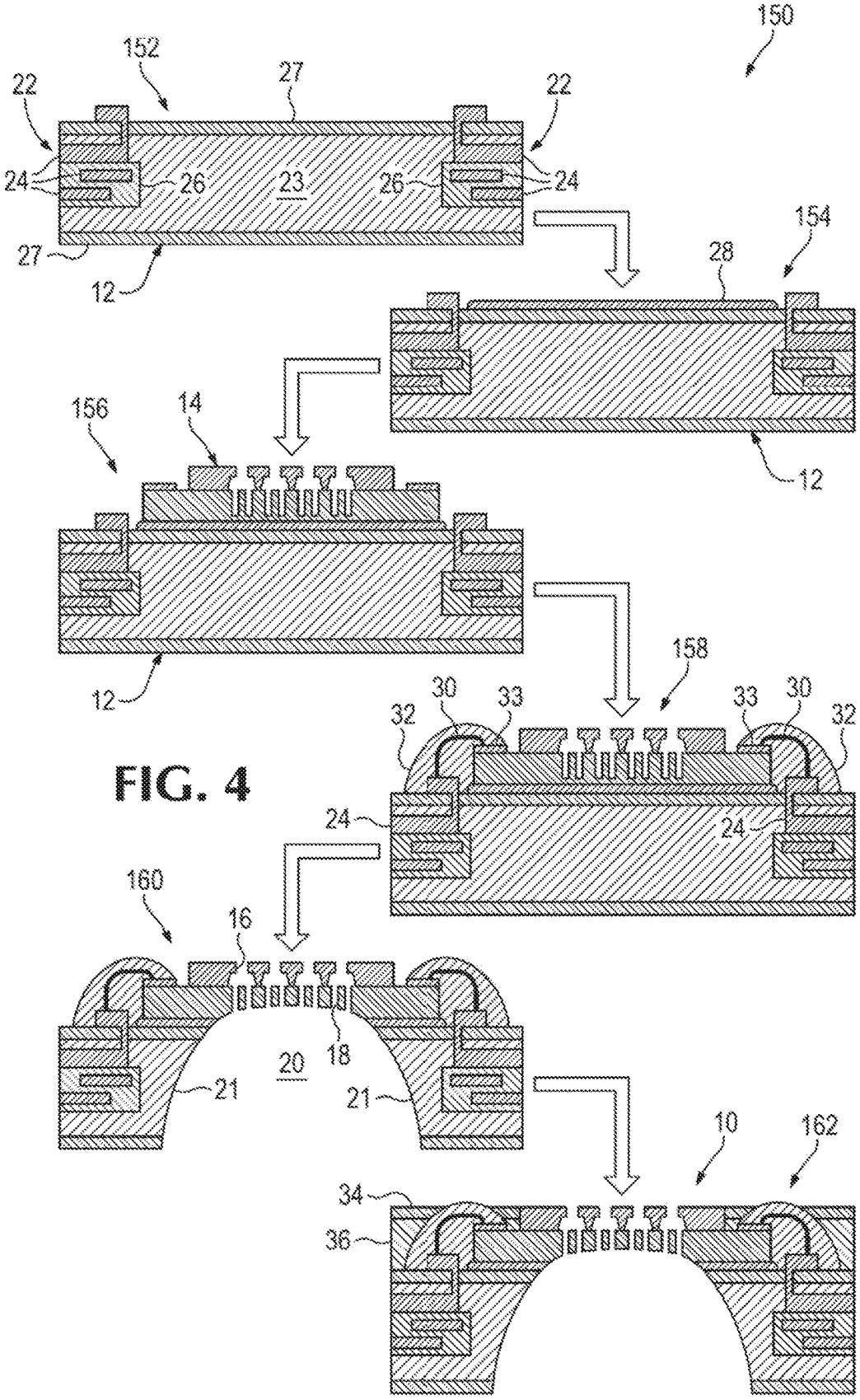
FIG. 4 is an example flow diagram for a process for forming a fluid ejection device.

FIG. 4 provides a flow diagram of an example process 150 for forming an example fluid ejection device, such as the fluid ejection device 10 of FIG. 1. In this example, a support manifold 12 comprising recessed structures 22 and a sealing structure 23 disposed therebetween (block 152) is processed by dispensing adhesive 28 onto a top surface of the support manifold 12 (block 154). A fluid ejection die 14 is coupled to the support manifold 12 with the adhesive 28 (block 156). The fluid ejection die 14 is electrically connected to conductive traces 24 of the support manifold 12 with conductive elements 30 (e.g., conductive wire) by coupling a respective conductive element 30 to a respective conductive trace 24 and a bond pad 33 of the fluid ejection die 14 (block 158). In addition, the conductive elements 30 may be encapsulated with an insulating material 32. A portion of the support manifold 12 corresponding to the sealing layer 23, a portion corresponding to the adhesive 28, and/or a portion corresponding to the fluid ejection die 14 is removed to thereby form the channel 20 having a fluid contact surface 21 (block 160). As shown, the channel 20 is formed such that fluid may flow from the channel 20 to the nozzles 16 for dispensing. In this example, a shroud 34 is coupled to a top surface of the fluid ejection device 10 with an adhesive 36 to thereby form a generally planar top surface for the fluid ejection device 10 (block 162). While in this example, a shroud 34 is included in the fluid ejection device, other examples may not include a shroud 34.

Figure 5:
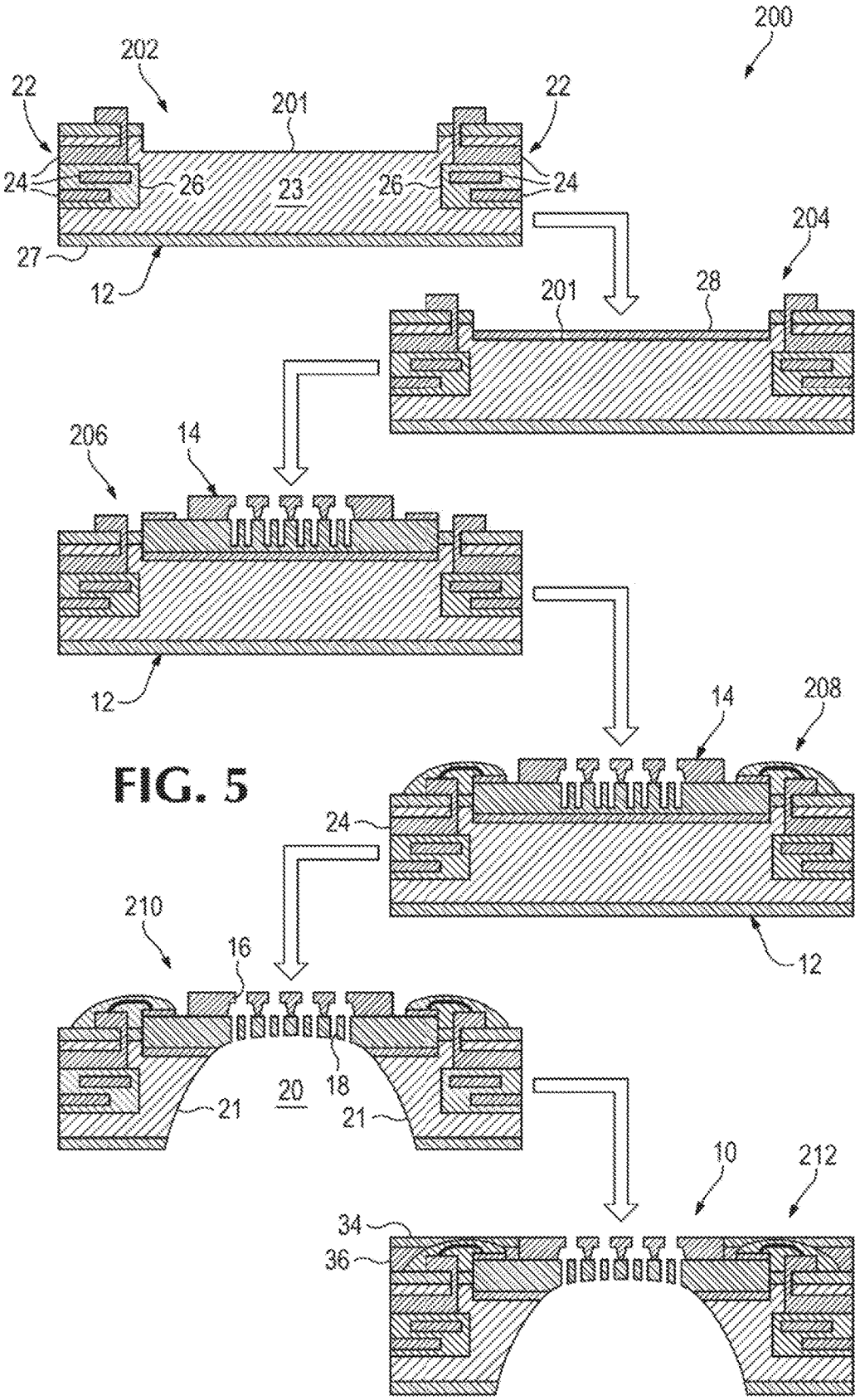
FIG. 5 is another example flow diagram for a process for forming a fluid ejection device.

FIG. 5 provides a flow diagram of an example process 200 for forming an example fluid ejection device, such as the fluid ejection device 10 of FIG. 1. In this example, a support manifold 12 that is configured with a recessed portion 201 on the top surface (block 202) is processed by dispensing adhesive 28 in the recessed portion 201 (block 204), and a fluid ejection die 14 is coupled to the support manifold 12 in the recessed portion 201 with the adhesive 28 (block 206). Conductive traces 24 of the support manifold 12 may be electrically connected to the fluid ejection die 14. In this example, conductive elements 30 are coupled to the conductive traces 24 of the support manifold 12 and bonding pads of the fluid ejection die 14, and the conductive elements 30 may be encapsulated with an insulating material 32 (block 208). A channel 20 may be formed through the sealing structure 23 of the support manifold 12, the adhesive 28, and/or the fluid ejection die 14 by removing a portion of the support manifold 12, the adhesive 28, and/or the fluid ejection die 14 (block 210). As shown, the channel 20 has a fluid contact surface 21 that corresponds to the sealing structure 23. Furthermore, formation of the channel 20 facilitates fluid passage through the channel 20 to the nozzles 16 of the fluid ejection die 14 for dispensing therefrom. Generally, the channel 20 may be fluidly connected to a fluid reservoir. In this example, a shroud 34 is coupled to a top surface of the fluid ejection device 10 with adhesive 38 (block 212).

As discussed previously, some examples of a fluid ejection device 10 may not include a shroud 34. For example, some fluid ejection devices 10 comprising a support manifold 12 configured with a recessed portion 201 on a top surface may not include a shroud 34. In such examples, because the fluid ejection die 14 may be coupled to the support manifold 12 in the recessed portion 201, a top surface of the fluid ejection device 10 may be generally planar without use of a shroud 34.

Figure 6:
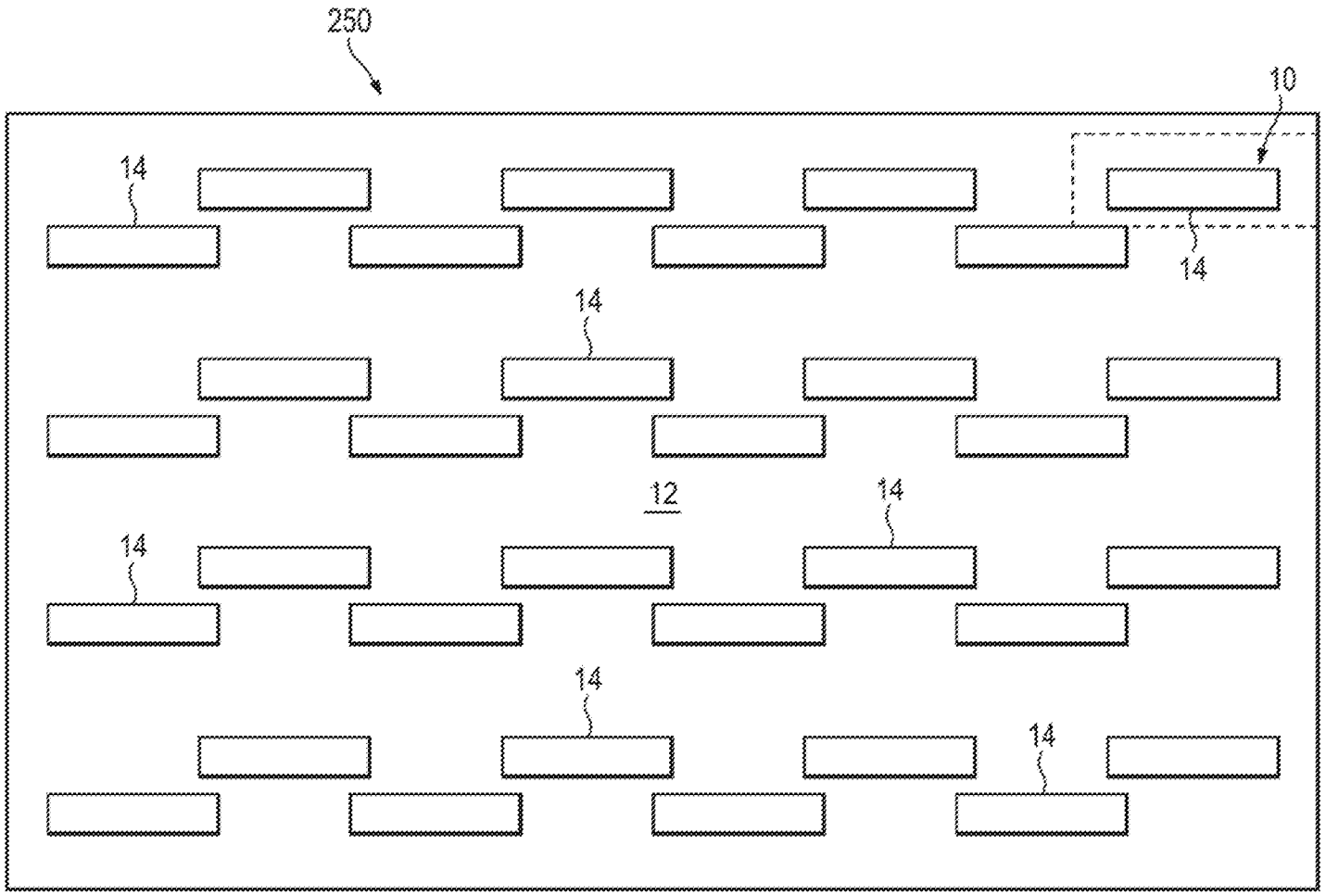
FIG. 6 is an example printhead implementing example fluid ejection devices.

FIG. 6 provides a top view of an example printhead 250 that may comprise a plurality of fluid ejection devices, such as the example fluid ejection device 10 of FIG. 1. In this example, a plurality of fluid ejection dies 14 are coupled to a support manifold 12. In some examples, the fluid ejection dies 14 may be arranged generally end-to-end. In this illustrated example, the fluid ejection dies 14 are arranged generally end-to-end in a staggered configuration. While not shown, each fluid ejection die 14 may be fluidly connected to a respective channel 20 formed through the support manifold 12.

The example printhead 250 includes four rows of fluid ejection dies 14 that are generally arranged across a width of the support manifold 12, where such configuration may be used in a page-wide print bar configuration for dispensing four respective fluids. For example, if the printhead 250 is included in an inkjet printer, four colors of ink may be used. Other examples may include more or less rows of fluid ejection devices 10 that are arranged in various configurations. Furthermore, conductive traces 24 (not shown) of the support manifold 12 may be electrically connected to each fluid ejection die 14 such that a fluid ejector associated with each nozzle 16 of each fluid ejection die 14 may be selectively actuated for the dispensing of fluid from the nozzle 16.

Figure 7:
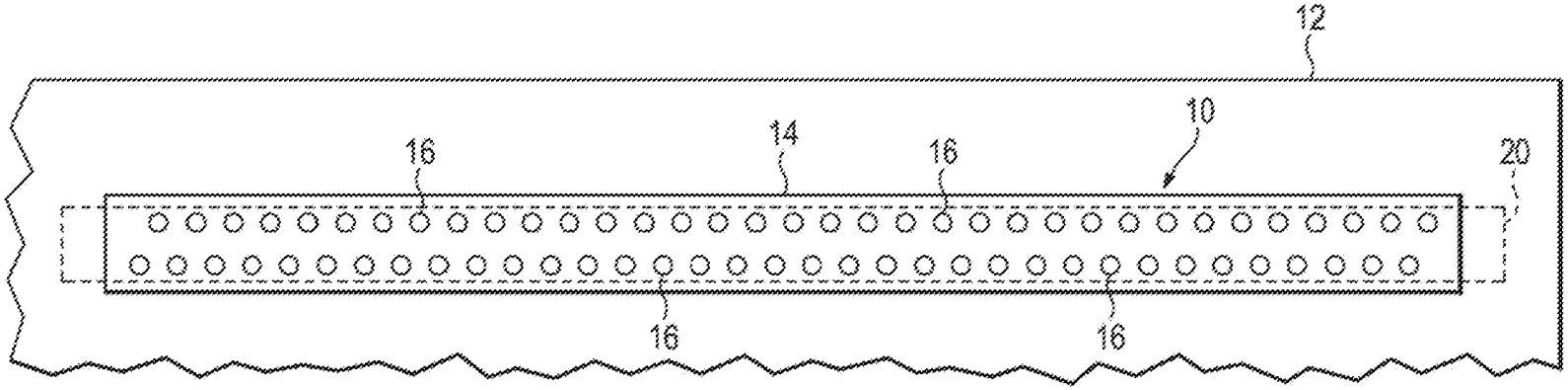
FIG. 7 is a detail from FIG. 6.

FIG. 7 is a detail view of an example fluid ejection device 10 of FIG. 6. As shown, the example fluid ejection device 10 comprises a fluid ejection die 14 configured with a plurality of nozzles 16. The fluid ejection die 14 is coupled to a top surface of the support manifold 12, and, as shown, a channel 20 (illustrated in phantom) is configured in a bottom surface of the support manifold 12. As discussed, the channel 20 is in fluid communication with the nozzles 16, such that fluid may be communicated from a fluid reservoir to the nozzles 16 for dispensing via the channel 20. In this example, the channel 20 is narrower than the fluid ejection die 14. However, in other examples, a width of the channel 20 may be equal or greater than a width of a fluid ejection die 14.

Figure 8:
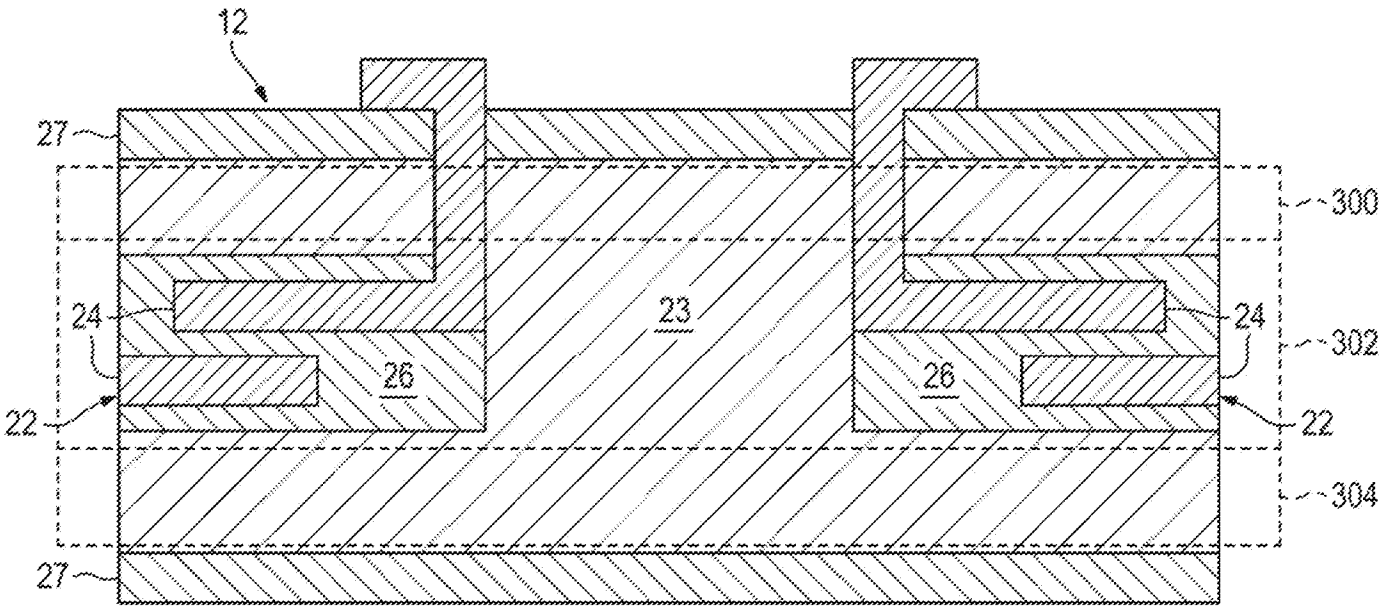
FIG. 8 is a cross-sectional view that illustrates an example of a support manifold that may be incorporated in an example fluid ejection device.

FIG. 8 provides a cross-sectional view of an example support manifold 12 before formation of a channel. In this example, layers 300-304 are highlighted to describe features of the example support manifold 12. A top layer 300 generally corresponds to the sealing structure 23, a bottom layer 304 generally corresponds to the sealing structure 23, and a middle layer 302 corresponds to the sealing structure 23 and the recessed structures 22. In some examples, the sealing structure 23 may comprise epoxy and/or an epoxy-based polymer. Hence, the top layer and bottom layer of the support manifold 12 in some examples may be a substantially uniform material, such as epoxy and/or an epoxy-based polymer. The middle layer includes the recessed structures 22 with the sealing structure 23 disposed therebetween. As will be appreciated, a channel may therefore be formed by removing a portion of the top layer 300, the middle layer 302, and the bottom layer 304, where the channel may be formed between recessed structures 22 of the middle layer.

The preceding description has been presented to illustrate and describe examples of the principles described. This description is not intended to be exhaustive or to limit these principles to any precise form disclosed. Many modifications and variations are possible in light of the description. Therefore, the foregoing examples provided in the figures and described herein should not be construed as limiting of the scope of the disclosure, which is defined in the Claims.

The invention claimed is:

1. A fluid ejection device, comprising:

a fluid ejection die having at least one nozzle to dispense fluid, the fluid ejection die having at least one port in fluid communication with the at least one nozzle to receive fluid to be dispensed by the at least one nozzle; and a support manifold coupled to the fluid ejection die, the support manifold having at least one channel passing therethrough to communicate fluid to the at least one port, the at least one channel having a fluid contact surface, the support manifold comprising at least one recessed structure spaced apart from the fluid contact surface, wherein the support manifold comprises a printed circuit board having an opening therethrough, the opening being filled with a mass of sealing material, a portion of which has been removed to form the at least one channel that extends through the sealing material and the opening.

2. The fluid ejection device of claim 1, wherein the at least one recessed structure comprises an insulating layer.

3. The fluid ejection device of claim 2, wherein the at least one recessed structure comprises a conductive trace connected to the fluid ejection die.

4. The fluid ejection device of claim 1, wherein the support manifold comprises:

a top layer comprising an epoxy based polymer and a bottom layer comprising an epoxy-based polymer;

a middle layer disposed between the top layer and the bottom layer, the middle layer comprising the at least one recessed structure and an epoxy based polymer, wherein the fluid contact surface of the at least one channel corresponds to the epoxy based polymer of the middle layer.

5. The fluid ejection device of claim 4, wherein the at least one recessed structure comprises a first recessed structure and a second recessed structure, the first recessed structure comprises a conductive trace connected to the fluid ejection die, the second recessed structure comprises a conductive trace connected to the fluid ejection die, the first recessed structure and the second recessed structure are positioned on opposite sides of the at least one channel, the first recessed structure and the second recessed structure are spaced apart from the fluid contact surface of the at least one channel by the epoxy based polymer of the middle layer.

6. The fluid ejection device of claim 1, wherein the support manifold comprises a top layer having a recessed surface, and the fluid ejection die is coupled to the support manifold at the recessed surface.

7. The fluid ejection device of claim 1, wherein at least one channel extends partially into the fluid ejection die.

8. The fluid ejection device of claim 1, wherein the sealing material encapsulates the printed circuit board.

9. A process comprising:

providing a printed circuit board having an opening therethrough;

filling the opening with a mass of sealing material, the printed circuit board and the opening filled with the sealing material forming a support manifold;

coupling a fluid ejection die having at least one nozzle on the support manifold, the support manifold comprising at least one recessed structure;

removing a portion of the sealing material presently in the opening to thereby form at least one channel passing through the opening of the printed circuit board of the support manifold, the at least one channel fluid fluidly connected to the at least one nozzle, the at least one channel having a fluid contact surface, and the at least one recessed structure is spaced apart from the fluid contact surface.

10. The process of claim 9, further comprising:

connecting at least one conductive trace of the recessed structure to the at least one fluid ejection die.

11. The process of claim 10, wherein the at least one conductive trace is connected to the at least one fluid ejection die prior to removing the portion of the support manifold to thereby form the at least one channel.

12. The process of claim 9, wherein removing the portion of the sealing material to thereby form the at least one channel comprises plunge cutting the sealing material.

13. The process of claim 9, further comprising:

coupling a shroud to a top surface of the support manifold.

14. The process of claim 9, wherein the portion of the sealing material is removed while the fluid ejection die is coupled to the support manifold.

15. The process of claim 9, wherein the at least one channel extends partially into the fluid ejection die.

16. A printhead comprising:

a support manifold having a plurality of channels passing therethrough, each channel having a fluid contact surface, and the support manifold comprising a plurality of recessed structures spaced apart from the fluid contact surface of each channel, wherein the support manifold comprises a printed circuit board having openings therethrough, the openings being filled with a mass of sealing material, a portion of which has been removed to form the plurality of channels that extend through the sealing material and the openings;

a plurality of fluid ejection dies coupled to the support manifold, each fluid ejection die comprising at least one nozzle connected to a respective channel to dispense fluid received from the respective channel.

17. The printhead of claim 16, wherein each recessed structure comprises a conductive trace, each fluid ejection die comprises a thermal fluid ejector that is connected to the conductive trace of two respective recessed structures for actuation thereby for the dispensing of fluid.

18. The printhead of claim 16, wherein the plurality of fluid ejection dies are arranged generally end to end along a length of the printhead.

19. The print head of claim 16, wherein each of the plurality of channels extend partially into one of the plurality of fluid ejection dies.

* * * * *